US011807491B2

(12) United States Patent
Lindig

(10) Patent No.: US 11,807,491 B2
(45) Date of Patent: Nov. 7, 2023

(54) SENSOR FOR FEEDING OF MEDIA SHEETS

(71) Applicant: Hewlett-Packard Development Company, L.P., Spring, TX (US)

(72) Inventor: Darin Duane Lindig, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 92 days.

(21) Appl. No.: 17/461,431

(22) Filed: Aug. 30, 2021

(65) Prior Publication Data

US 2023/0064298 A1 Mar. 2, 2023

(51) Int. Cl.
*B65H 7/20* (2006.01)
*B65H 7/02* (2006.01)

(52) U.S. Cl.
CPC ..... *B65H 7/20* (2013.01); *B65H 7/02* (2013.01); *B65H 2511/412* (2013.01); *B65H 2511/511* (2013.01)

(58) Field of Classification Search
CPC ... B65H 7/00; B65H 7/02; B65H 7/20; B65H 29/00; B65H 31/00; B65H 43/00; B65H 43/02; B65H 43/04; B65H 43/06; B65H 2511/412; B65H 2511/511
See application file for complete search history.

(56) References Cited

U.S. PATENT DOCUMENTS 4,624,546 A * 11/1986 Fukushi ..... B65H 31/24 399/13
8,632,070 B2 * 1/2014 Nonaka ..... G03G 15/6561 399/376
2012/0327447 A1 * 12/2012 Funakawa ..... G06F 3/044 358/1.13
2016/0353946 A1 * 12/2016 Osborne, Jr. ..... B65H 16/005
2016/0353947 A1 * 12/2016 Osborne, Jr. ..... B65H 16/06
2018/0250969 A1 * 9/2018 Nicklos ..... B65H 31/02
2020/0351415 A1 * 11/2020 Okuzono ..... G06K 15/406

* cited by examiner

*Primary Examiner* — Prasad V Gokhale
(74) *Attorney, Agent, or Firm* — Brooks, Cameron & Huebsch, PLLC

(57) ABSTRACT

According to examples, an apparatus may include a media feed mechanism, printing components, an output tray, a sensor, a processor, and a memory on which is stored machine-readable instructions. The instructions may cause the processor to receive a signal from the sensor corresponding to a detection by the sensor of a movement that triggers output of the signal from the sensor. The instructions may also, based on receipt of the signal, cause the media feed mechanism to feed a sheet of media out of the apparatus into the output tray.

14 Claims, 4 Drawing Sheets

SENSOR FOR FEEDING OF MEDIA SHEETS

BACKGROUND

Printing devices often include input trays that hold sheets of media upon which images may be printed prior to the media being outputted from the printing devices. Following the printing of the images on the media, the media is often outputted to an output tray for retrieval by a user.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
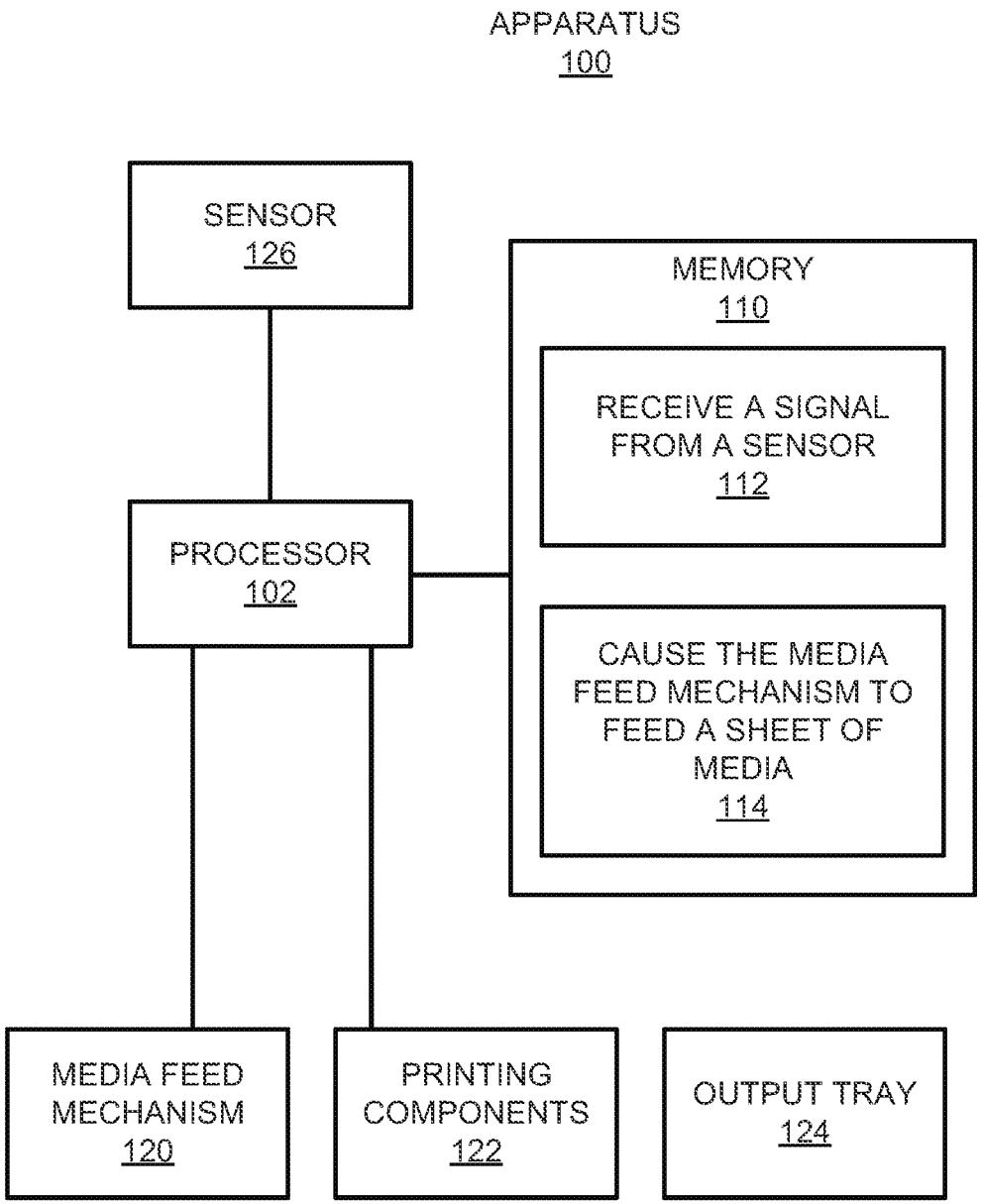
FIG. 1 shows a block diagram of an example apparatus, in which an example processor of the apparatus may cause a media feed mechanism of the apparatus to feed a sheet of media out of the apparatus based on receipt of a signal from a sensor.

For simplicity and illustrative purposes, the principles of the present disclosure are described by referring mainly to examples thereof. In the following description, numerous specific details are set forth in order to provide an understanding of the examples. It will be apparent, however, to one of ordinary skill in the art, that the examples may be practiced without limitation to these specific details. In some instances, well known methods and/or structures have not been described in detail so as not to unnecessarily obscure the description of the examples. Furthermore, the examples may be used together in various combinations.

Throughout the present disclosure, the terms "a" and "an" are intended to denote at least one of a particular element. As used herein, the term "includes" means includes but not limited to, the term "including" means including but not limited to. The term "based on" means based at least in part on.

Users of printing devices often pull sheets of media from input trays of printing devices when the users want a sheet of media, for instance, a scrap piece of paper. In order to pull the sheet of media from the input tray, a user may remove the input tray from the printing device and may grab a sheet of media from the input tray. Following removal of the sheet of media from the input tray, the user may insert the input tray into the printing device.

The printing devices and the input trays are not normally designed for the input trays to be removed and inserted a large number of times, Instead, the input trays of printing devices are normally designed to accurately and reliably stage sheets of media for pick and feed. Each time an input tray is removed from a printing device and inserted back into the printing device, there is an increased possibility of subsequent jamming of the printing device, which may increase downtime and potential collateral mechanical damage to the printing device. This may occur because the input tray and/or the printing device may not be properly inserted each time that the input tray is inserted into the printing device. Additionally, this may occur through the disruption of the media stack alignment and orientation because of the media or input tray removal.

Disclosed herein are apparatuses, such as printing apparatuses, in which the apparatuses each includes a sensor that, when triggered, may cause a sheet of media to be expelled from an apparatus. Particularly, the apparatuses may also each includes a processor that may receive a signal from the sensor when the sensor detects a movement that triggers output of the signal. Based on receipt of the signal, the processor may cause a media feed mechanism of the apparatus to feed a sheet of media out of the apparatus, for instance, into the output tray. In some examples, the sensor may be positioned along a feed path that the sheet of media follows when the sheet of media is expelled from an output port of the apparatus to the output tray. In this regard, when a user intends to obtain a sheet of media from the apparatus, the user may place their hand along the feed path and in a position to receive the sheet of media as the sheet of media is expelled from the output port. In other examples, the sensor may be positioned at other locations on the apparatus, such as a lower portion of the apparatus where a user may wave their foot in front of the sensor. In yet other examples, the sensor may be an image scanner of the apparatus.

In some examples, the processor may cause a blank sheet of media to be fed out of the apparatus while in other examples, the processor may cause an image to be printed onto the sheet of media prior to the sheet of media being expelled. The image may be a name, a date, a logo, and/or the like, and various images may be predefined for multiple users.

Through implementation of the features of the present disclosure, a user may obtain a sheet of media from an apparatus, e.g., a printing device, in a simple and efficient manner. Particularly, the user may obtain the sheet of media without having to remove an input tray that houses the sheet of media and replacing the input tray after obtaining the sheet of media. In addition, the user may obtain the sheet of media by simply placing their hand in or near the output tray of the apparatus, by placing their foot near a bottom of the apparatus, or the like, which may further simplify obtaining of the sheet of media. A technical issue with obtaining the sheet of media by pulling the input tray out of the apparatus may be that the re-insertion of the input tray may lead to paper jams, which may harm or reduce the useful life of the apparatus. A technical improvement afforded through implementation of the features of the present disclosure may be that sheets of media, such as blank sheets of media, may be outputted without needing that the input tray be removed, which may reduce paper jams and may extend the useful life of the apparatus.

Reference is first made to FIG. 1, which shows a block diagram of an example apparatus 100, in which an example processor 102 of the apparatus 100 may cause a media feed mechanism 120 of the apparatus 100 to feed a sheet of media out of the apparatus 100 based on receipt of a signal from a sensor. It should be understood that the example apparatus 100 may include additional features and that some of the features described herein may be removed and/or modified without departing from the scope of the apparatus 100.

Generally speaking, the apparatus 100, which is also referenced herein as a printing apparatus 100, may be a printing device such as a laser printer, a thermal inkjet printer, a piezoelectric printer, a multi-function printer, a desktop printer, and/or the like. In addition, the processor 102, which may control operations of the apparatus 100, may be a semiconductor-based microprocessor, a central processing unit (CPU), an application specific integrated circuit (ASIC), a field-programmable gate array (FPGA), and/or other hardware device. The apparatus 100 may also include a memory 110, which may also be termed a computer readable medium. The memory 110 may be, for example, a Random Access memory (RAM), an Electrically Erasable Programmable Read-Only Memory (EEPROM), a storage device, or the like. The memory may be a non-transitory computer readable storage medium, where the term "non-transitory" does not encompass transitory propagating signals.

As shown, the apparatus 100 may include a media feed mechanism 120, printing components 122, an output tray 124, and a sensor 126. The media feed mechanism 120 may include various components for feeding sheets of media through the apparatus 100. For instance, the media feed mechanism 120 may include pickers, rollers, sensors, and/or the like. The printing components 122 may include various components for performing a printing action on the sheets of media that the media feed mechanism 120 may feed through the apparatus 100. In this regard, the printing components 122 may include inkjet printheads, a toner drum, a toner cartridge, a laser beam source, a fuser roller, a heater, and/or the like. The output tray 124 may be a tray or other receptacle into which the sheets of media may be fed following expulsion of the sheets of media from the apparatus 100.

The sensor 126, which is also referenced herein as a contactless sensor, may be a sensor to detect a movement. Particularly, the sensor 126 may detect when an object has been positioned within a sensing field of the sensor 126. By way of particular example, the sensor 126 may detect when a user has positioned their hand, foot, or other object within the sensing field. In addition or as other examples, the sensor 126 may detect multiple gestures of a user. The gestures may include, for instance, a certain number of fingers that a user is holding within the sensing field of the sensor 126, a type of movement that the user's finger and/or hand is making within the sensing field of the sensor 126, and/or the like. The sensing field of the sensor 126 may be an area adjacent to the sensor 126 within which movement of an object may cause the sensor 126 to output a signal.

As discussed in greater detail herein, according to some examples, the sensor 126 may be positioned within or adjacent to the output tray 124. In some examples, the sensor 126 may be positioned along a front and bottom portion of the apparatus 100. In yet other examples, the sensor 126 may be an image scanner of the apparatus 100 and may be positioned beneath a scanner glass of the apparatus. In any of these examples, a user may interact with the sensor 126 without interacting, for instance, with a control panel (FIG. 2, element 206) of the apparatus 100. In addition, the sensor 126 may be an optical sensor, an inductive, a capacitive, a photo-electric, a through beam, a retroreflective, a passive infrared, a microwave, a reflective, an ultrasonic, a lidar, and/or the like sensor.

As shown, the memory 110 may have stored thereon a set of instructions 112-114 that the processor 102 may execute. In other examples, the instructions 112-114 may be stored as software on the processor 102. In any of these examples, the processor 102 may execute the instructions 112 to receive a signal from the sensor 126 corresponding to a detection by the sensor 126 of a movement that triggers output the signal from the sensor 126. In addition, the processor 102 may execute the instructions 114 to, based on receipt of the signal, cause the media feed mechanism 120 to feed a sheet of media out of the apparatus 100. Particularly, the processor 102 may cause the media feed mechanism 120 to feed the sheet of media out of the apparatus 100 and onto the output tray 124 without the printing components 122 performing a printing action on the sheet of media. In this regard, for instance, a user may simply interact with the sensor 126 to obtain a sheet of media, such as a plain or scrap sheet of media, from the apparatus 100.

Figure 2:
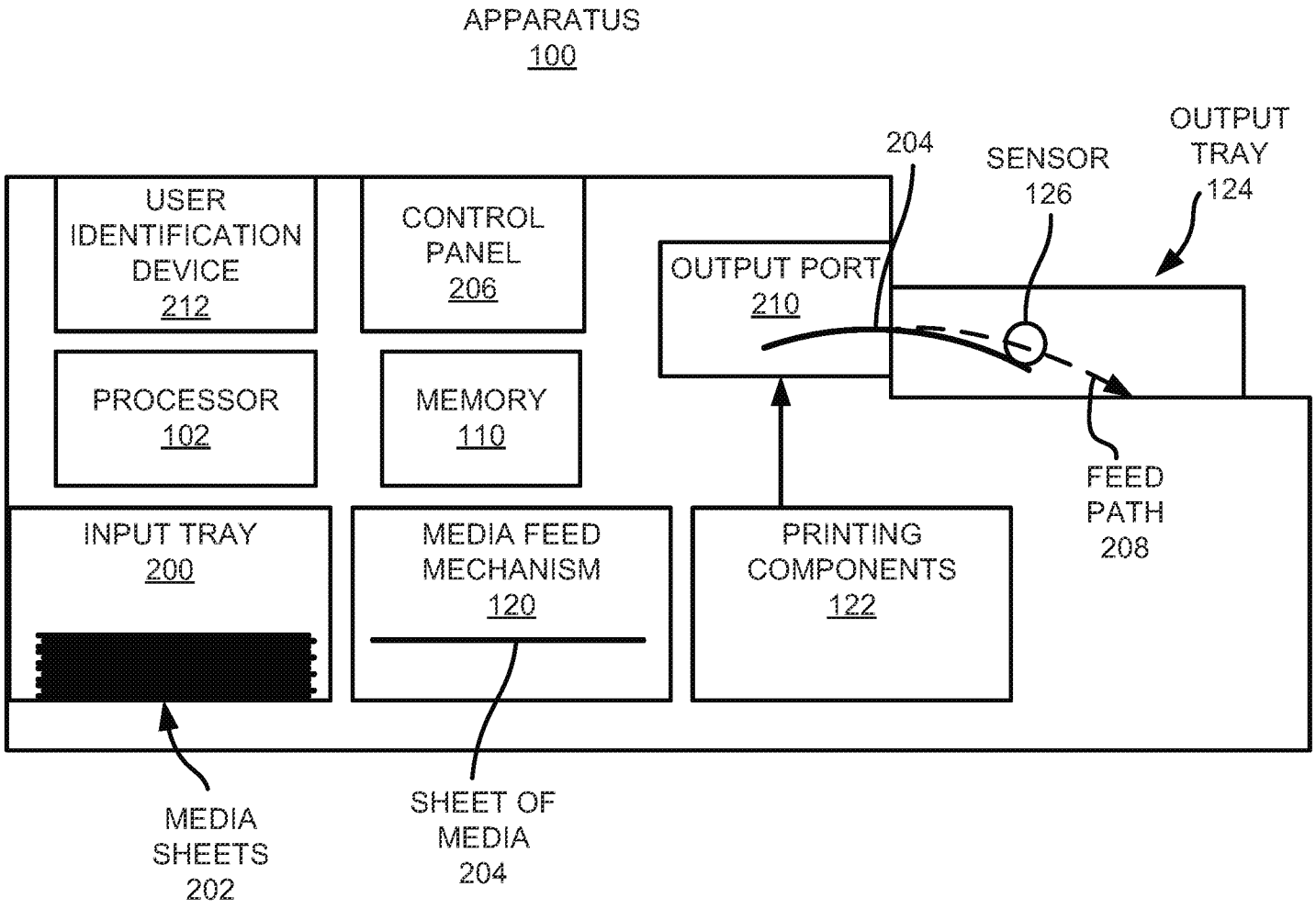
FIG. 2 shows a block diagram of the example apparatus depicted in FIG. 1, in which the block diagram shown in FIG. 2 depicts components of the example apparatus in addition to those depicted in the block diagram of FIG. 1.

Reference is now made to FIG. 2, which shows a block diagram of the example apparatus 100 depicted in FIG. 1, in which the block diagram shown in FIG. 2 depicts components of the example apparatus in addition to those depicted in the block diagram of FIG. 1. As shown in FIG. 2, the apparatus 100 may include the processor 102, the memory 110, the media feed mechanism 120, the printing components 122, the output tray 124, and the sensor 126. Additionally, the apparatus 100 may include an input tray 200, within which media sheets 202 may be supported. Particularly, the input tray 200, which may also be termed a cassette or the like, that may be inserted into and removed from an opening in the apparatus 100. For instance, the input tray 200 may be removed from the apparatus 100 and a stack of the media sheets 202, such as paper, may be inserted into the apparatus 100. The input tray 200 may include components that may enable individual sheets of the media 202 to be removed or picked from the input tray 200. The components may be, for instance, a spring that may push leading edges of the media sheets 202 upwardly, guiding elements for positioning the media sheets 202 within the input tray 200, etc.

As discussed herein, users may pull the input tray 200 out of the apparatus 100 and may grab a sheet of media 204 from the input tray 200 to obtain a sheet of media 204. The users may pull the sheet of media 204 from the input tray 200 to obtain a sheet of blank, e.g., scrap, media upon which the users may write notes and/or the like. Following removal of the sheet of media 204 from the input tray 200, the user may insert the input tray 200 back into the apparatus 100. Thus, the user may perform a number of steps just to obtain a sheet of blank media. In some instances, the user may not properly insert the input tray 200 into the apparatus 100, which may result in the media sheets 202 being improperly fed through the apparatus 100. The improper feeding of the media sheets 202 may cause jams and/or other problems in the apparatus 100, which may not only cause delays in the performance of print jobs, but may cause stress on the apparatus 100. The stress may reduce the useful life of the apparatus 100.

According to examples, when a user intends to obtain a sheet of media 204 from the apparatus 100, the user may trigger the sensor 126, such as by positioning their hand or foot within the sensor field of the sensor 126. As shown in FIG. 2, the sensor 126 may be positioned within or adjacent to the output tray 124. In other examples, the sensor 126 may be positioned at other locations of the apparatus 100 that are positioned away from a control panel 206 of the apparatus 100. Particularly, for instance, the sensor 126 may be positioned within a feed path 208 along which the sheets of media 202 may be fed out of the apparatus 100 and into the output tray 124. That is, the apparatus 100 may include an output port 210 positioned adjacent to the output tray 124 such that the sheets of media 202 that are outputted through the output port 210 move past the sensor 126 as the sheets of media 202 fall into the output tray 124. In some examples, a user may place their hand along the feed path 208 when the user intends to obtain a sheet of media 204 from the input tray 200 of the apparatus 100. The user's hand may thus be in a position to receive the sheet of media 204 as the sheet of media 204 is expelled through the output port 210 of the apparatus 100.

Following detection by the sensor 126 of a movement within the sensing field of the sensor 126 that triggers output of the signal from the sensor 126, the sensor 126 may output a signal to the processor 102. The processor 102 may also receive the signal, which may equivalently be termed an electrical signal, from the sensor 126. In addition, based on receipt of the signal, the processor 102 may cause the media feed mechanism 120 to feed a sheet of media 204 out of the apparatus 100. Particularly, for instance, the media feed mechanism 120 may cause a topmost sheet of media 204 to be picked from the input tray 200, fed past the printing components 122, and fed out of the apparatus 100 through the output port 210.

According to examples, the processor 102 may determine whether the apparatus 100 is performing a print operation when the signal from the sensor 126 is received. In these examples, based on a determination that the apparatus 100 is performing a print operation when the signal is received, the processor 102 may not control the media feed mechanism 120 to feed the sheet of media 204 out of the apparatus 100. In other words, while the apparatus 100 is performing a printing operation and the sensor 126 detects a triggering operation for the signal to be outputted, the processor 102 may not cause the sheet of media 204 to be outputted from the apparatus 100. In this manner, a user may not interrupt a print operation (which may be defined as a pending print job and/or a currently performed print job) in order to obtain the sheet of media 204 from the apparatus 100.

In some examples, when the apparatus 100 receives a print job and is preparing to perform the print job, for instance, warming up the printing components 122, the processor 102 may not cause the sheet of media 204 to be outputted from the apparatus 100. In other examples, the apparatus 100 may cause the sheet of media 204 to be outputted from the apparatus 100 while the printing components 122 are warming up.

In some examples, the processor 102 may cause the sheet of media 204 to be fed by or past the printing components 122 without causing the printing components 122 to perform a printing action on the sheet of media 204. In these examples, the sheet of media 204 may be outputted from the apparatus 100 as a blank or scrap sheet of media 204. In other examples, the processor 102 may control the printing components 122 to perform a printing action on the sheet of media 204 prior to the sheet of media 204 being fed out of the apparatus 100. That is, the processor 102 may cause or control the printing components 122 to print a predefined image onto the sheet of media 204 as the sheet of media 204 is fed by the printing components 122. The predefined image may be, for instance, the name of the user that triggered the output of the sheet of media 204, a date, a company logo, a design, predefined text, and/or the like.

In the examples in which the processor 102 causes the printing components 122 to perform a printing action on the sheet of media 204, the processor 102 may select the predefined image from a number of predefined images. For instance, the processor 102 may determine an identity of the user who caused the sensor 126 to detect the triggering movement and may select a predefined image associated with the identified user. The processor 102 may further cause the printing components 122 to print the selected predefined image.

According to examples, a plurality of users may use the apparatus 100, such as in office or home environments. In these examples, some or all of the users may store respective predefined images associated with the users and the predefined images associated with the users may be stored, for instance in a data store (not shown) of the apparatus 100. In addition, the processor 102 may select the predefined image from the stored predefined images and the identification of the user who caused the sensor 126 to the detect the triggering movement by the sensor 126.

In some examples, the apparatus 100 may include a user identification device 212 that may identify the identity of the user of the apparatus 100. The user identification device 212 may include, for instance, an identification card reader that may read the identification card of the user when the identification card of the user is within a certain distance of the apparatus 100. The certain distance may be, for instance, a distance that is within a maximum sensing distance of the user identification device 212. By way of example, the user identification device 212 may include a radio frequency identification device (RFID) that may output RF signals and the identification card may send a response to the user identification device 212 when the identification card is within a proximity to the user identification device 212.

As other examples, the user identification device 212 may include a keypad or other input device into which the user may enter an identification number or other identification code of the user. As yet further examples, the user identification device 212 may include a biometric reader that may read a biological feature of the user to determine the identification of the user.

According to examples, the sensor 126 may capture multiple user hand movements. For instance, the sensor 126 may be an optical sensor, such as a camera, that may capture multiple images of a users movements, e.g., hand/or finger gestures, and may output signals corresponding to the captured images. By way of particular example, the sensor 126 may output data corresponding to the captured images to the processor 102. The processor 102 may determine the users movements through analysis of the multiple images. Particularly, the processor 102 may determine a type of user gesture from the multiple signals received from the sensor 126. The type of user gesture may be, for instance, whether the user moved their finger vertically or horizontally, whether the user moved their finger in a circular movement, whether the user moved one finger or two fingers, and/or the like.

According to examples, the types of the user gestures may correspond to different printing actions. For instance, a first type of user gesture may correspond to a printing action in which the printing components 122 do not apply a printing medium onto the sheet of media 204. A second type of user gesture may correspond to a printing action in which the processor 102 causes the printing components 122 to print a date onto the sheet of media 204. A third type of user gesture may correspond to a printing action in which the processor 102 causes the printing components 122 to print a user's name onto the sheet of media 204. Additional types of user gestures may correspond to other printing actions. For instance, different types of user gestures may correspond to sheets of differently sized media to be outputted, such as a letter size media, a legal size media, a postcard, etc., to be outputted.

The processor 102 may identify the certain type of printing action to be performed on the sheet of media 204 based on the determined type of user gesture. In addition, the processor 102 may cause the printing components 122 to perform the identified certain type of printing action prior to the sheet of media 204 being outputted from the apparatus 100. Thus, a user may perform a certain type of user gesture in order to obtain a blank sheet of media 204 or a sheet of media 204 with a certain type of image printed on the sheet of media 204.

Figure 3:
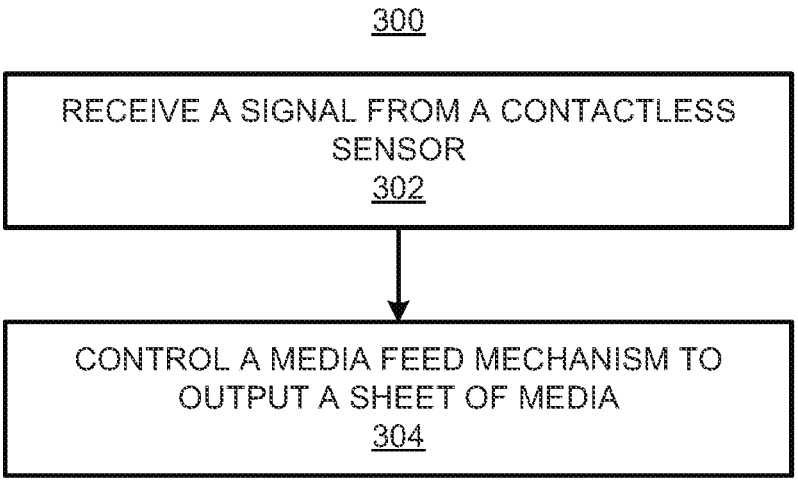
FIG. 3 depicts a flow diagram of an example method for controlling a media feed mechanism to output a sheet of media into an output tray responsive to a signal from a contactless sensor outputting a signal to a processor.

Various manners in which the processor 102 of the apparatus 100 may operate are discussed in greater detail with respect to the method 300 depicted in FIG. 3. Particularly, FIG. 3 depicts a flow diagram of an example method 300 for controlling a media feed mechanism 120 to output a sheet of media 204 into an output tray 124 responsive to a contactless sensor 126 outputting a signal to a processor 102. It should be understood that the method 300 may include additional operations and that some of the operations described therein may be removed and/or modified without departing from the scope of the method 300. The description of the method 300 is made with reference to the features depicted in FIGS. 1-2 for purposes of illustration.

At block 302, the processor 102 may receive a signal from a sensor 126, which may be positioned within or adjacent to an output tray 124 of a printing apparatus 100. As discussed herein, the sensor 126 may output the signal in response to the sensor 126 detecting that a triggering movement by a user has occurred.

At block 304, the processor 102 may, based on receipt of the signal, control a media feed mechanism 120 of the printing apparatus 100 to output a sheet of media 204 into the output tray 124. As discussed herein, the processor 102 may control printing components 122 of the printing apparatus 100 to either enable the sheet of media 204 to be outputted as a blank sheet of media 204 or to print an image on the sheet of media 204 prior to the sheet of media 204 being outputted.

Some or all of the operations set forth in the method 300 may be included as utilities, programs, or subprograms, in any desired computer accessible medium. In addition, the method 300 may be embodied by computer programs, which may exist in a variety of forms both active and inactive. For example, they may exist as machine-readable instructions, including source code, object code, executable code or other formats. Any of the above may be embodied on a non-transitory computer readable storage medium.

Examples of non-transitory computer readable storage media include computer system RAM, ROM, EPROM, EEPROM, and magnetic or optical disks or tapes. It is therefore to be understood that any electronic device capable of executing the above-described functions may perform those functions enumerated above.

Figure 4:
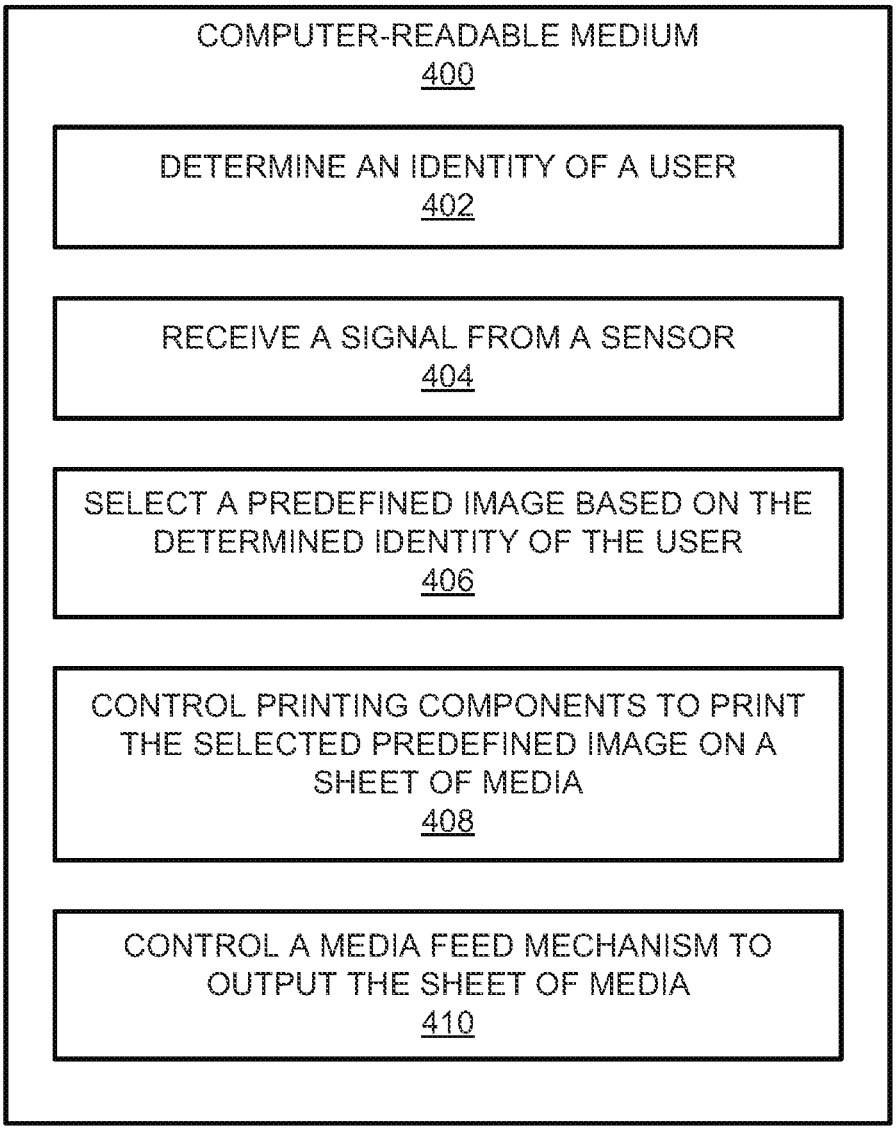
FIG. 4 shows a block diagram of an example computer-readable medium that may have stored thereon computer-readable instructions for controlling a media feed mechanism to output a sheet of media into an output tray responsive to a signal from a contactless sensor outputting a signal to a processor.

Turning now to FIG. 4, there is shown a block diagram of an example computer-readable medium 400 that may have stored thereon computer-readable instructions for controlling a media feed mechanism 120 to output a sheet of media 204 into an output tray 124 responsive to a sensor 126 outputting a signal to a processor 102. It should be understood that the computer-readable medium 400 depicted in FIG. 4 may include additional instructions and that some of the instructions described herein may be removed and/or modified without departing from the scope of the computer-readable medium 400 disclosed herein. The computer-readable medium 400 may be a non-transitory computer-readable medium, in which the term "non-transitory" does not encompass transitory propagating signals.

The computer-readable medium 400 may have stored thereon computer-readable instructions 402-404 that a processor, such as the processor 102 of the apparatus 100 depicted in FIGS. 1 and 2, may execute. The computer-readable medium 400 may be an electronic, magnetic, optical, or other physical storage device that contains or stores executable instructions. The computer-readable medium 400 may be, for example, Random Access memory (RAM), an Electrically Erasable Programmable Read-Only Memory (EEPROM), a storage device, an optical disc, and the like.

The processor may fetch, decode, and execute the instructions 402 to determine an identity of a user of an apparatus 100. As discussed herein, the processor may determine the identity of the user via the user identification device 212. The processor may fetch, decode, and execute the instructions 404 to receive a signal from a sensor 126 positioned within or adjacent to an output tray 124 of the apparatus 100. As discussed herein, the sensor 126 may output the signal in response to the sensor 126 detecting that a triggering movement by a user has occurred.

The processor may fetch, decode, and execute the instructions 406 to select a predefined image based on the determined identity of the user. In addition, the processor may fetch, decode, and execute the instructions 408 to control printing components 122 of the apparatus 100 to print the selected predefined image on a sheet of media 204. The processor may further fetch, decode, and execute the instructions 410 to control a media feed mechanism to output the sheet of media 204 from the apparatus 100.

Although described specifically throughout the entirety of the instant disclosure, representative examples of the present disclosure have utility over a \wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the scope of the disclosure, which is intended to be defined by the following claims—and their equivalents—in which all terms are meant in their broadest reasonable sense unless otherwise indicated.

What is claimed is:

1. An apparatus comprising:

a media feed mechanism;

printing components;

an output tray;

a sensor;

a processor; and a memory on which is stored machine-readable instructions that, when executed by the processor, cause the processor to:

receive a signal from the sensor corresponding to a detection by the sensor of a movement of a user of the apparatus that triggers output of the signal from the sensor; and based on receipt of the signal, cause the media feed mechanism to feed a blank sheet of media out of the apparatus into the output tray without the printing components performing a printing action on the blank sheet of media prior to the blank sheet of media being fed out of the apparatus.

2. The apparatus of claim 1, further comprising:

an output port through which sheets of media are to be ejected through a feed path onto the output tray; and wherein the sensor is positioned at a location along the feed path of the sheets of media between the output port and the output tray.

3. The apparatus of claim 1, wherein the sensor is to output multiple signals corresponding to user movements, and wherein the instructions cause the processor to:

determine a type of user gesture from the multiple signals received from the sensor;

identify a media type based on the determined type of user gesture; and cause the apparatus to feed a blank sheet of the identified media type as the blank sheet of media being outputted from the apparatus.

4. The apparatus of claim 3, wherein identifying the media type based on the determined type of user gesture comprises corresponding the type of user gesture to different sizes of media including letter size media, legal size media, and postcard size media.

5. The apparatus of claim 1, wherein the instructions cause the processor to determine whether the apparatus is warming up when the signal is received, and based on a determination that the apparatus is warming up when the signal is received, to not control the media feed mechanism to feed the blank sheet of media out of the apparatus.

6. The apparatus of claim 1, wherein the instructions further cause the processor to:

determine whether the apparatus has received a print job when the signal is received;

based on a determination that the apparatus has received the print job, determine whether the apparatus is warming up for preparation of the print job; and based on a determination that the apparatus is warming up in response to receiving the print job, control the media feed mechanism to feed the blank sheet of media out of the apparatus.

7. The apparatus of claim 1, wherein the instructions further cause the processor to determine whether the apparatus is performing a print operation when the signal is received, and based on a determination that the apparatus is performing the print operation when the signal is received, to not control the media feed mechanism to feed the blank sheet of media out of the apparatus.

8. The apparatus of claim 1, wherein the instructions further cause the processor to:

determine whether the apparatus has received a print job when the signal is received;

based on a determination that the apparatus has received the print job, determine whether the apparatus is warming up for preparation of the print job; and based on a determination that the apparatus is warming up in response to receiving the print job, not control the media feed mechanism to feed the blank sheet of media out of the apparatus.

9. An apparatus comprising:

an output tray;

an output port through which sheets of media are to be outputted from an interior of the apparatus through a feed path to the output tray;

a sensor positioned within or adjacent to the output tray;

a media feed mechanism;

a processor; and a memory on which is stored machine-readable instructions that, when executed by the processor, cause the processor to:

receive a signal from the sensor corresponding to a detection by the sensor of a movement of a user of the apparatus that triggers output of the signal from the sensor; and based on receipt of the signal, cause the media feed mechanism to feed a blank sheet of media through the output port and into the output tray without printing components of the apparatus performing a printing action on the blank sheet of media prior to the blank sheet of media being fed out of the apparatus.

10. The apparatus of claim 9, wherein the sensor is positioned at a location along the feed path of the sheets of media between the output port and the output tray.

11. The apparatus of claim 9, wherein the instructions further cause the processor to determine whether the apparatus is performing a print operation when the signal is received, and based on a determination that the apparatus is performing a print operation when the signal is received, to not control the media feed mechanism to feed the blank sheet of media out of the apparatus.

12. The apparatus of claim 9, wherein the sensor is an image scanner and the sensor is positioned at a location beneath a scanner glass of the apparatus.

13. A method comprising:

receiving, by a processor, a signal from a sensor positioned within or adjacent to an output tray of a printing apparatus, wherein the sensor is to output the signal in response to detecting a triggering movement of a user; and based on receipt of the signal, controlling, by the processor, a media feed mechanism of the printing apparatus to output a blank sheet of media into the output tray.

14. The method of claim 13, further comprising:

determining a type of gesture of the user as the triggering movement of the user;

identifying a media type based on the determined type of user gesture; and controlling the printing apparatus to feed a blank sheet of the identified media type as the blank sheet of media being outputted to the output tray.

* * * * *